US011110511B2

(12) United States Patent
Kritikos

(10) Patent No.: US 11,110,511 B2
(45) Date of Patent: Sep. 7, 2021

(54) CONTINUOUS CASTER ROLL HAVING A SPIRAL FLUTED AXLE

(71) Applicant: Roser Technologies, Inc., Titusville, PA (US)

(72) Inventor: Timothy G. Kritikos, Oil City, PA (US)

(73) Assignee: Roser Technologies, Inc., Titusville, PA (US)

( * ) Notice: Subject to any disclaimer, the term of this patent is extended or adjusted under 35 U.S.C. 154(b) by 236 days.

(21) Appl. No.: 16/359,158

(22) Filed: Mar. 20, 2019

(65) Prior Publication Data

US 2019/0291175 A1 Sep. 26, 2019

Related U.S. Application Data

(60) Provisional application No. 62/646,746, filed on Mar. 22, 2018.

(51) Int. Cl.

*B22D 11/06* (2006.01)
*B22D 11/128* (2006.01)
*B22D 11/00* (2006.01)

(52) U.S. Cl.

CPC ..... *B22D 11/0682* (2013.01); *B22D 11/005* (2013.01); *B22D 11/0611* (2013.01); *B22D 11/0651* (2013.01); *B22D 11/1287* (2013.01)

(58) Field of Classification Search

CPC ..... B22D 11/0682; B22D 11/0611; B22D 11/0651

See application file for complete search history.

(56) References Cited

U.S. PATENT DOCUMENTS

| | | | | |
|---|---|---|---|---|
| 4,093,023 A * | 6/1978 | Frantsenjuk | F28D 11/02 165/89 |
| 6,426,969 B2 * | 7/2002 | Fontana | F27D 3/08 373/20 |
| 7,601,110 B2 * | 10/2009 | Brotzki | B22D 11/1287 384/313 |
| 2015/0290703 A1 * | 10/2015 | Kunstreich | B22D 11/0651 164/504 |

FOREIGN PATENT DOCUMENTS

| | | | |
|---|---|---|---|
| DE | 2707907 A1 * | 8/1977 | F28F 5/02 |
| FR | 2289271 A1 * | 5/1976 | B22D 11/1287 |
| SU | 1678511 A1 * | 9/1991 | B22D 11/1287 |
| WO | WO-2015011149 A2 * | 1/2015 | B22D 11/1287 |

OTHER PUBLICATIONS

English Machine Translation of DE-2707907-A1 (Year: 1977).*
English Machine Translation of FR-2289271-A1 (Year: 1976).*

* cited by examiner

*Primary Examiner* — Sarang Afzali
(74) *Attorney, Agent, or Firm* — Jonathan M. D'Silva; MMI Intellectual Property

(57) ABSTRACT

A roll for continuous casting comprises a cylindrical roll rotatably mounted on a fixed axle and said axle comprising a coolant inlet system and a coolant outlet system. A cooling chamber receives a flow of coolant. The coolant chamber is defined by the space between the interior of the cylindrical roll and the axle. Two overlapping spirals are formed onto the axle that creates a helical flow path from the coolant inlet system to the coolant outlet system.

7 Claims, 2 Drawing Sheets

CONTINUOUS CASTER ROLL HAVING A SPIRAL FLUTED AXLE

BACKGROUND

In continuous casting installations for casting metal strands, rolls are used to guide the metal strand along a predetermined path after leaving the mold and to cool it and possibly support it. The rolls comprise rotatably mounted cylindrical rolls that are free rolling on a fixed axle. The cylindrical rolls rotate as the metal strands move over them. As these rolls are exposed to high temperatures in operation by being in direct contact with the glowing hot metal strands, cooling of the rolls is a high priority. This is typically conducted in a closed circuit by a feed of a coolant (in particular water) under pressure into the interior of the roll to dissipate the heat. Prior art systems typically have included complicated pressure control systems and sealing units that are prone to failure and require significant efforts for maintenance and repair. What is presented is a roll for high temperature environments that has an improved coolant circuit system that addresses some of the drawbacks of prior art systems.

SUMMARY

The roll for continuous casting comprising a cylindrical roll rotatably mounted on a fixed axle. The axle comprising a coolant inlet system and a coolant outlet system. A cooling chamber is defined by the space between the interior of the cylindrical roll and the axle. The cooling chamber receives a flow of coolant. At least one spiral is formed onto the axle that creates a helical flow path from the coolant inlet system to the coolant outlet system. In some embodiments, two overlapping spirals are formed onto the axle. The spiral could comprise ¼" wide flutes.

The coolant inlet system comprises a first coolant inlet into the axle located along the centerline of the axle and a first coolant outlet from the axle into the cooling chamber. A first fluid path through the axle directs coolant from the first coolant inlet to the first coolant outlet for the non-turbulent flow of coolant into the cooling chamber. The first coolant outlet directs the flow of coolant towards the spirals on the axle.

The coolant outlet system comprises a second coolant inlet into the axle from the coolant chamber. A second coolant outlet from the axle is located along the centerline of the axle. A second fluid path through the axle directs coolant from the second coolant inlet to the second coolant outlet for the non-turbulent flow of coolant.

In various embodiments, the coolant is water. The coolant may be introduced into the coolant chamber at a pressure of 80 psi. The coolant may be introduced into the coolant chamber at a rate of 5 gpm.

Those skilled in the art will realize that this invention is capable of embodiments that are different from those shown and that details of the devices and methods can be changed in various manners without departing from the scope of this invention. Accordingly, the drawings and descriptions are to be regarded as including such equivalent embodiments as do not depart from the spirit and scope of this invention.

BRIEF DESCRIPTION OF DRAWINGS

For a more complete understanding and appreciation of this invention, and its many advantages, reference will be made to the following detailed description taken in conjunction with the accompanying drawings.

DETAILED DESCRIPTION

Figure 1:
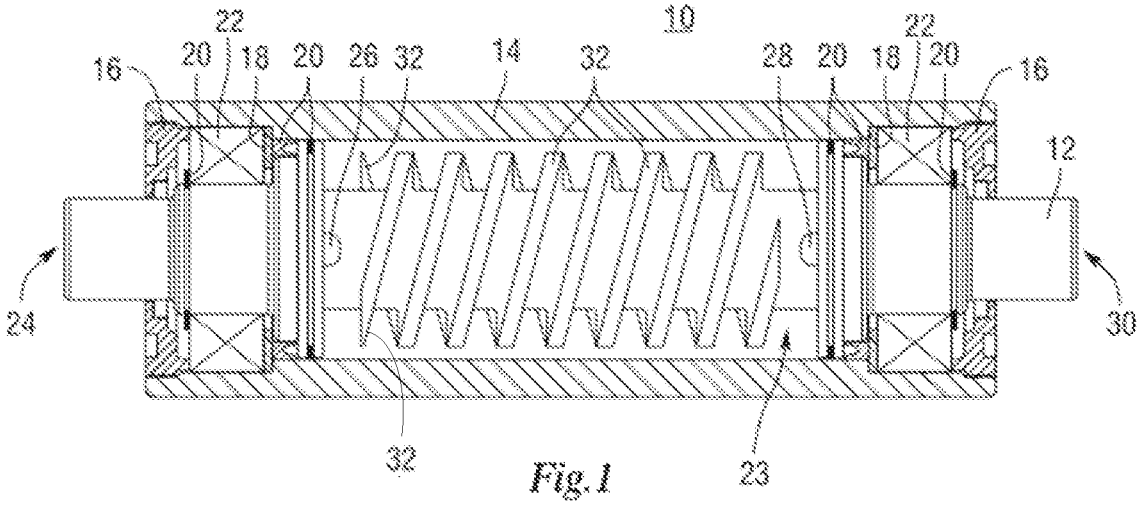
FIG. 1 is a cut-out view of a roll that incorporates a spiral fluted axle.

Referring to the drawings, some of the reference numerals are used to designate the same or corresponding parts through several of the embodiments and figures shown and described. Corresponding parts are denoted in different embodiments with the addition of lowercase letters. Variations of corresponding parts in form or function that are depicted in the figures are described. It will be understood that variations in the embodiments can generally be interchanged without deviating from the invention.

Figure 2:
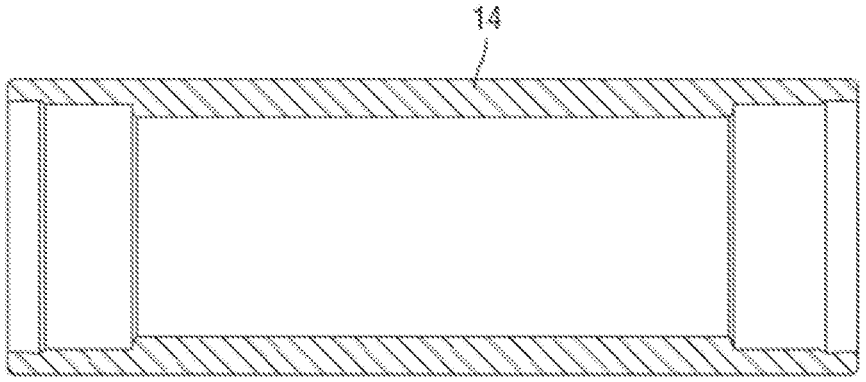
FIG. 2 is a cross-sectional view of the cylindrical roll in which a spiral fluted axle is inserted.

FIG. 1 shows a perspective view of a roll 10 for continuous casting of metal strands. Rolls 10 such as these act as guides in continuous casting applications to direct extremely hot metal strands as they cool. A plurality of such rolls 10 are arranged in sequence to support and guide metal strands along the casting facility. Each roll 10 comprises a fixed axle 12 onto which a cylindrical roll 14, as shown in FIG. 2, is mounted. The cylindrical roll 14 is rotatable on the fixed axle 12 such that the cylindrical roll 14 rotates when metal strands move over the roll 10 while the axle 12 remains fixed. The roll 10 is mounted on a roll support system that is immaterial to this disclosure and most known systems and methods for securing the roll 10 in place may be implemented so long the features of the roll 10 disclosed herein are accommodated.

Because each roll 10 comes in direct contact with the metal strands, heat transfer and cooling of each roll 10 is essential. It has been determined that the heat transfer system disclosed herein provides a better metal strand product that is less prone to cracking and warping as the metal stand cools along the path of rolls 10. The cylindrical rolls 14 are typically constructed of stainless steel, but any other appropriate material may be used that can bear the weight and heat of the metal strands that they are required to come in contact with.

As best understood by comparing FIGS. 1, 2, 4, and 4A, the cylindrical roll 14 is mounted to the axle 12 and supported with sealed spherical roll bearings 22. A cooling chamber 23 is formed between the axle 12 and the cylindrical roll 14. Retainer covers 16 seal the ends of the roll 10 and spacer plates 18 are used to seat the spherical roll bearings 22 within the cylindrical roll 14. A series of gaskets 20 of various types and used to provide a liquid seal between the moving parts.

Figure 3:
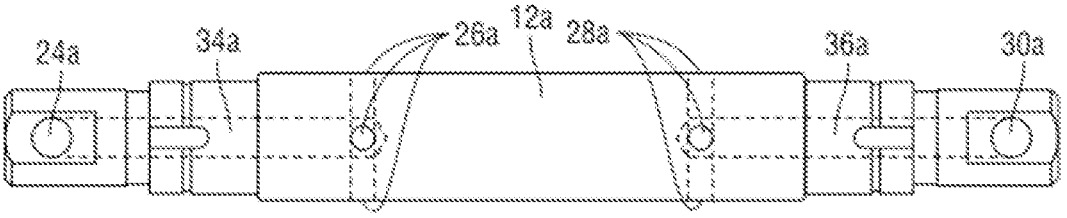
Prior Art Fig.3
FIG. 3 is a view of a prior art axle.

The cooling chamber is fed with a coolant liquid through a coolant inlet system that feeds coolant into the cooling chamber 23. Low temperature coolant flows into the cooling chamber through the coolant inlet system and heated coolant is drained from the coolant chamber through a coolant outlet system. In prior art axles 12*a*, as shown in FIG. 3, the coolant inlet system and the coolant outlet systems are integrated with the roll support structures and the first coolant inlet 24*a* located at one end of the axle 12*a* is typically fed from a coolant line that leads into the axle 12*a* at a 90° angle from the centerline of the axle 12*a*. A coolant feed line 34*a* leads the coolant to one or a series of first coolant outlets 26*a* that drain into the coolant chamber. These first coolant outlet(s) 26*a* are also typically formed at 90° angles from the centerline of the axle 12*a*. Coolant fills the coolant chamber and exchanges heat from the surface of the cylindrical roll and then drains through the coolant outlet system at the other end of the axle 12*a*. The coolant outlet system typically mirrors the coolant inlet system and would have one or a series of second coolant inlets 28*a* that are also typically formed at a 90° angles from the centerline of the axle 12*a*. The second coolant inlet(s) 28*a* drain into a coolant drain line 36*a* that leads to a second coolant outlet 30*a* that is are also typically formed at a 90° angle from the centerline of the axle 12*a*. The 90° bends cause turbulent flow within the cooling chamber. This configuration has its limitations and is not the most efficient heat exchange system. What is presented is an improved system that addresses some of these limitations.

As best understood by comparing FIGS. 1, 2, 4, and 4A, the roll 10 presented herein has significant differences over the prior art. The cylindrical roll 14 is rotatably mounted on the fixed axle 12. The axle 12 comprises a coolant inlet system and a coolant outlet system, described in more detail later. As discussed earlier, retainer covers 16 seal the ends of the roll 10 and spacer plates 18 are used to seat the spherical roll bearings 22 within the cylindrical roll 14. A series of gaskets 20 of various types and used to provide a liquid seal between the moving parts of the roll. A cooling chamber 23 is formed that is defined by the space between the interior of the cylindrical roll 14 and the exterior of the axle 12. At least one spiral 32 is formed onto the axle 12 that creates a helical flow path from the coolant inlet system to the coolant outlet system. In some embodiments, as shown in the figures, two overlapping spirals 32 may be formed onto the axle 12. The spirals 32 formed on the axle 12 may be a variety of configurations but it is preferred that each spiral comprises ¼" wide flutes.

The coolant inlet system of this roll 10 is different that what is presented in the prior art. The coolant inlet system comprises a first coolant inlet 24 into the axle 12 that is located along the centerline of the axle 12. A first coolant outlet 26 from the axle 12 leads into the cooling chamber 23. A first fluid path 34 through the axle 12 from the first coolant inlet 24 to the first coolant outlet 26 provides non-turbulent flow of coolant into the cooling chamber. As can be seen in FIG. 4A, the first fluid path 34 does not have any sharp bends allowing for the smooth flow of coolant through the coolant inlet system. The first fluid outlet 26 directs the flow of coolant towards the at least one spiral 32 that is formed on the axle 12. It will be understood that the number of first fluid outlets 26 could be varied to direct coolant flow to other locations on the axle 12 so long as the flow of coolant remains non-turbulent.

The coolant outlet system is like the coolant inlet system. A second coolant inlet 28 drains into the axle 12 from the coolant chamber 23. The second coolant outlet from the axle 12 is located along the centerline of the axle 12. A second fluid path 36 through the axle 12 from the second coolant inlet 28 to the second coolant outlet 30 provides non-turbulent flow of coolant out of the roll 10.

Figure 4:
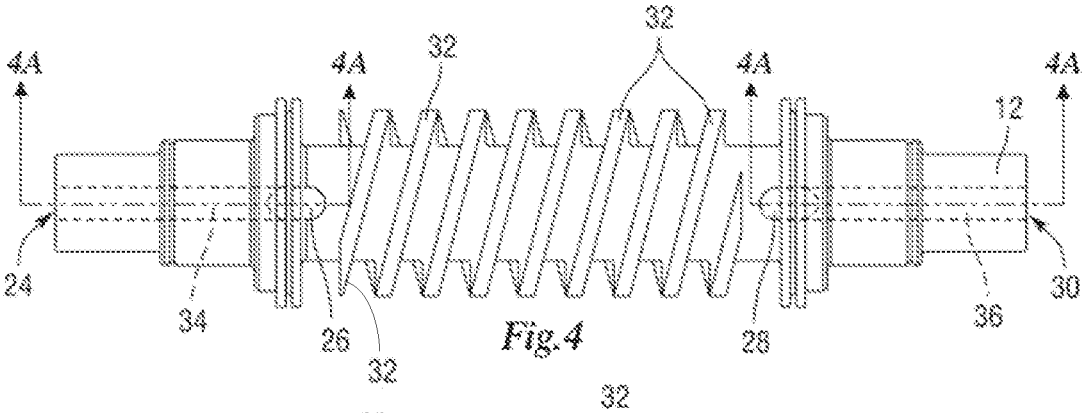
FIG. 4 is a view of the spiral fluted axle.
Figure 4A:
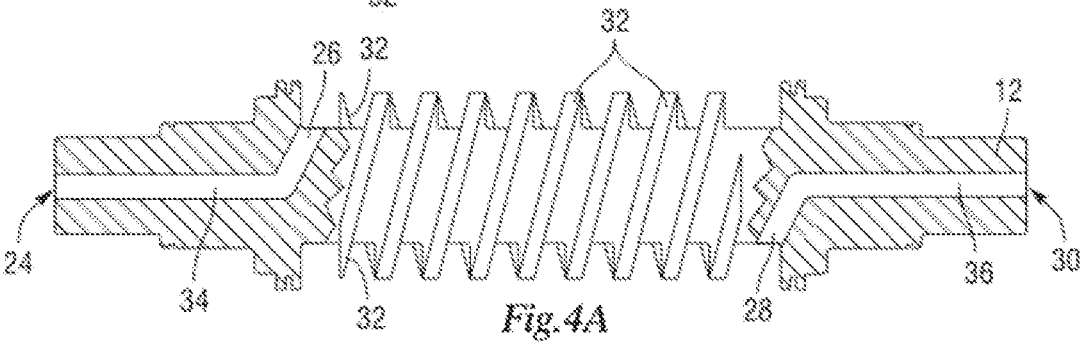
FIG. 4A is a partially cut out view of the spiral fluted axle of FIG. 4.
Figure 4B:
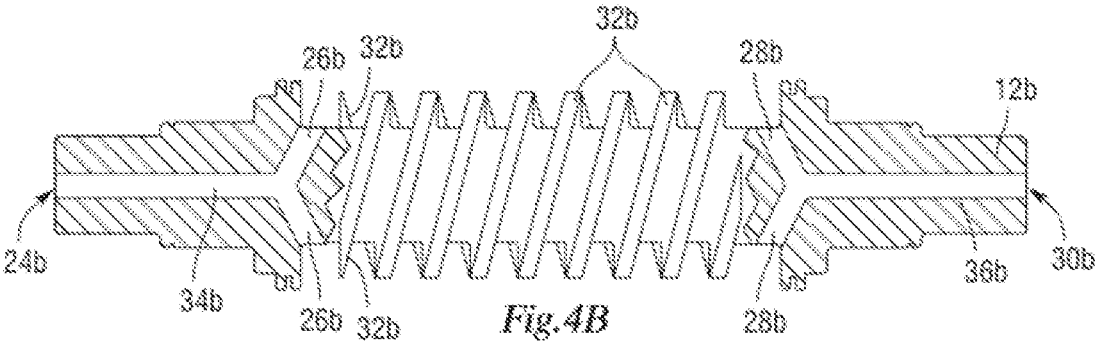
FIG. 4B is a partially cut out view of another embodiment of a spiral fluted axle in which the coolant inlet system has multiple first coolant outlets and second coolant inlets.

FIG. 4B shows another embodiment of the spiral fluted axle 12*b* in which the coolant inlet system has multiple first coolant outlets 26*b* and second coolant inlets 28*b*. This is particularly useful in embodiments in which the spiral fluted axle 12*b* has two spirals 32*b* formed onto it. In these embodiments, it is preferred that each first coolant outlet 26*b* is located to direct coolant flow into a pathway formed by the spirals 32*b*.

Figure 5:
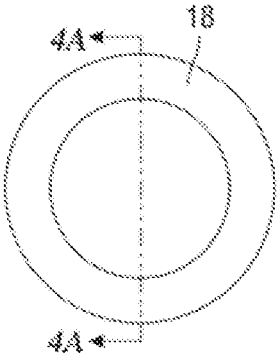
FIG. 5 is a front view of a spacer.
Figure 5A:
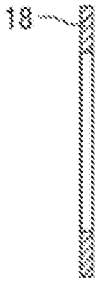
FIG. 5A is a cross section view of the spacer of FIG. 5.
Figure 6:
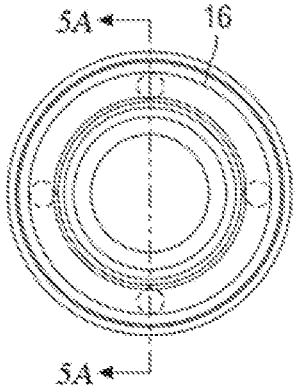
FIG. 6 is a front view of a retainer cap.
Figure 6A:
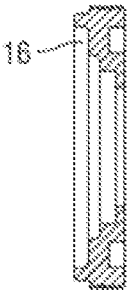
FIG. 6A is a cross section view of the retainer cap of FIG. 6.

FIGS. 5 and 5A show front and cross-sectional views of one of the spacers 18 that seat the spherical roll bearings 22 within the cylindrical roll 14. FIGS. 6 and 6A show front and cross-sectional views of one of the retainer caps 16 that seal the ends of the roll 10.

The coolant used in the system can be any coolant system that is typical for this type of system, but the preferred coolant is water. The system shown allows coolant introduction at various pressures, but it is the preferred that coolant is introduced into the coolant chamber at a pressure of 80 psi. Coolant introduction flow rate into the coolant chamber is 5 gpm.

Testing was conducted comparing the spiral configuration shown in FIG. 4 to the prior art system shown in FIG. 3 based on a constant 5 gpm water supply:

| | Coolant Supply Pipe | | | | First Coolant Inlet Ports on Axle | | |
|---|---|---|---|---|---|---|---|
| | Size | I.D. | Area ($in^2$) | Velocity (fps) | I.D. | Area ($in^2$) | Velocity (fps) |
| Prior Art | ⅜ Sch 40 | 0.493 | 0.191 | 8.40 | 0.578 | 0.262 | 6.11 |
| Spiral Axle | ½ Sch40 | 0.622 | 0.304 | 5.28 | 0.578 | 0.262 | 6.11 |

| | First Coolant Outlets Into Coolant Chamber | | | | Cross Sectional Area of Coolant Chamber | | | |
|---|---|---|---|---|---|---|---|---|
| | Number of Outlets | I.D. | Area ($in^2$) | Velocity (fps) | I.D. | O.D. | Area ($in^2$) | Velocity (fps) |
| Prior Art | 4 | 3/8 | X0.110 | 3.65 | 3.252 | 2.000 | 5.164 | 0.31 |
| Spiral Axle | 2 | 7/16 | 0.150 | 5.35 | 3.000 | 2.625 | 1.660 | 0.74 |

The prior art system, of course, did not have spirals on the axle. The spiral axle system experienced about 2.4 times greater fluid velocity through the roll. Higher coolant velocity means heat is pulled away from the cylindrical roll at faster rates which helps prevent the roll from overheating. An overheated roll can eventually cause defects on the metal slabs that roll over it.

The two spirals on the axle help direct the coolant flow around the axle, which eliminates hot spots. Having a predetermined coolant flow path reduces the chance for cavitation in the roll body. Cavitation leads to air bubbles and pockets which impede heat transfer. Air bubbles act as insulation preventing heat transfer to the coolant inside the roll body.

The tests show an increased water velocity in the spiral axle roll cavity over prior art systems given the same coolant supply properties. The spiral axle configuration reduces the opportunity for turbulence to occur. The fluid paths coolant inlet system and the coolant outlet system for in the spiral axle configuration further reduces the opportunity for cavitation to occur. The first coolant inlet and the second coolant outlet direct coolant to enter and exit the axle through the centerline of the axle. Prior art systems direct coolant to enter and leave the axle at 90° to the axle which can initiate turbulences in the coolant flow. The spiral axle configuration can be scaled up or down by increasing the length of the axle depending on specific application requirements, however the water flow properties will remain constant.

This invention has been described with reference to several preferred embodiments. Many modifications and alterations will occur to others upon reading and understanding the preceding specification. It is intended that the invention be construed as including all such alterations and modifications in so far as they come within the scope of the appended claims or the equivalents of these claims.

The invention claim is:

1. A roll for continuous casting comprising:

a cylindrical roll rotatably mounted on a fixed axle;

said axle comprising a coolant inlet system and a coolant outlet system;

a cooling chamber for receiving a flow of coolant, said cooling chamber defined by a space between an interior of said cylindrical roll and said axle; and two overlapping spirals formed onto said axle that creates a helical flow path from said coolant inlet system to said coolant outlet system.

2. The roll of claim 1 in which said coolant inlet system further comprises:

a first coolant inlet into said axle located along a longitudinal centerline of said axle;

a first coolant outlet from said axle into said cooling chamber;

a first fluid path through said axle from said first coolant inlet to said first coolant outlet for a non-turbulent flow of coolant into said cooling chamber; and said first coolant outlet directs the flow of coolant towards said spirals.

3. The roll of claim 2 in which said coolant outlet system further comprises:

a second coolant inlet into said axle from said cooling chamber;

a second coolant outlet from said axle located along the longitudinal centerline of said axle; and a second fluid path through said axle from said second coolant inlet to said second coolant outlet for the non-turbulent flow of coolant.

4. The roll of claim 1 further comprising said cooling chamber is capable of receiving water as a coolant.

5. The roll of claim 1 further comprising said coolant cooling chamber is capable of receiving coolant at a pressure of 80 pounds per square inch (psi).

6. The roll of claim 1 further comprising said cooling chamber is capable of receiving coolant at a rate of 5 gallons per minute (gpm).

7. The roll of claim 1 further comprising each said spirals comprises ¼ inch (¼") wide flutes.

* * * * *